United States Patent [19]

Nunan

[11] 4,049,291

[45] Sept. 20, 1977

[54] COMBINATION REMOVABLE RELEASE SKI BINDING

[76] Inventor: Denis M. Nunan, P.O. Box 397, Breckenridge, Colo. 80424

[21] Appl. No.: 669,880

[22] Filed: Mar. 24, 1976

[51] Int. Cl.[2] ..... A63C 9/086

[52] U.S. Cl. ..... 280/614; 280/620

[58] Field of Search ..... 280/614, 620, 636, 633, 280/626

[56] References Cited

U.S. PATENT DOCUMENTS

| | | | |
|---|---|---|---|
| 2,686,059 | 8/1954 | Whitaker | 280/614 |
| 2,758,846 | 8/1956 | Swensen | 280/614 |
| 3,357,713 | 12/1967 | See, Jr. | 280/620 |
| 3,388,918 | 6/1968 | Hollenback | 280/614 |
| 3,434,731 | 3/1969 | Keeling | 280/620 |
| 3,877,712 | 4/1975 | Weckeiser | 280/614 |
| 3,953,042 | 4/1976 | Pyzel et al. | 280/614 |

*Primary Examiner*—Joseph F. Peters, Jr.
*Assistant Examiner*—David M. Mitchell

[57] ABSTRACT

A spring type holder, releasably mounted on a ski for supporting a boot heel holder, includes a removable boot heel holder for alpine skiing, and permitting cross country skiing in the absence of the heel holder.

4 Claims, 9 Drawing Figures

COMBINATION REMOVABLE RELEASE SKI BINDING

This invention relates to ski bindings, and more particularly to a combination cross country and alpine ski binding, arranged to support a removable boot heel holder, permitting alpine skiing with a cross country ski binding.

Two different types of skiing are currently most popular with the general skiing public. These are cross country and alpine skiing. In the first, the skier walks or hikes on skis which, of course, for ease requires the lifting of the heel during the walking. The walking attitude also involves the skis alternately along the snow. A particular type of binding and a light weight, normally low cut, ski boot has been devised for this type of skiing. The binding securely holds the boot toe to the ski but permits freely lifting the heel. In the alpine or down hill skiing, the ski binding holds the boot (generally above the ankle type) with the entire sole and heel flatly to the ski, so that the ski moves with the foot, giving lateral and pivot control of the ski.

These two types of bindings are different and are not compatible. However, in cross country skiing, one must go down some hills. It is generally more convenient to have the boot heel affixed to the ski for control. A number of inventions have attempted to provide a combined ski binding; and generally such bindings are heavy and awkward. Also, skiers generally prefer a safety binding (i.e., releasable when too much twisting, lateral, vertical or other stresses occur in a spill). These features for a combined binding are not found in the devices of the prior art. For example, U.S. Pat. No. 3,575,437 to Unger for Releasable Heel Retainer for Ski Binding with Means for Optional Setting for Starting and Cross Country Events, dated Apr. 20, 1971, does not show a stable device permitting free heel movement and for fixed heel holding. Weickeiser U.S. Pat. No. 3,877,712 for Release Ski Binding for Down Hill and Cross Country dated Apr. 15, 1975, shows a ski binding attached to a ski which is intended for both types of skiing. The unit adds weight to a cross country ski when such skis and bindings should be light. Also, the heel is not free but held in an around the boot cable. Similarly, Jones, in U.S. Pat. No. 2,831,696 dated Apr. 22, 1958 for Ski Binding uses an around the boot cable, while Swensen U.S. Pat. No. 2,758,846 dated Aug. 14, 1956 for Ski Binding Provided with Heel Control Device uses an around the boot spring clamp. An earlier around the boot cable with a heel clamp is shown in Whitaker U.S. Pat. No. 2,686,059 dated Aug. 10, 1954.

According to the present invention, I have provided a light weight combined ski binding using a removable heel holder which provides adjustable release tension when attached to the ski mounted heel holder for a safety binding. The heel binding is attachable to the spring holder, which may be adjusted for stress release from the ski for a safety release. The spring holder and binding, therefore, are attached to the boot heel, and the spring holder and binding release from the ski but remain on the boot.

It is, therefore, among the objects and advantages of the invention to provide a combined cross country and alpine ski binding.

Another object of the invention is to provide a combined cross country and alpine ski binding having an adjustable release stress safety binding.

Yet another object of the invention is to provide a ski binding having a removable boot heel holder for converting a cross country type binding to down hill or alpine type binding Still another object of the invention is to provide a light weight ski binding converting a cross country type binding to an alpine type binding with the addition of a minimum amount of weight to a cross country ski.

An additional object of the invention is to provide a simple conversion attachment to a cross country ski binding forming an alpine ski binding.

A further object of the invention is to provide simple means for modifying existing cross country ski bindings to combined cross country and alpine bindings with an adjustable stress safety release.

These and other objects and advantages may be readily ascertained by reference to the following description and appended illustrations, wherein.

In general, the device of the invention provides a means for converting a cross country type ski binding to a combination ski binding arranged for a free heel lift for cross country skiing, and a fixed heel position for alpine type skiing. The device utilizes a conventional cross country ski binding which affixes the toe to the ski and permits free lifting of the heel for walking. The conversion includes a plate mounted on the ski beneath the heel of the boot. A removable spring heel binding support is arranged to be releasably mounted on the plate. A heel binding cable with a tightening latch is attachable to the spring holder for securing the heel to the plate in an adjustable stress release fashion providing a safety binding for alpine skiing.

Figure 1:
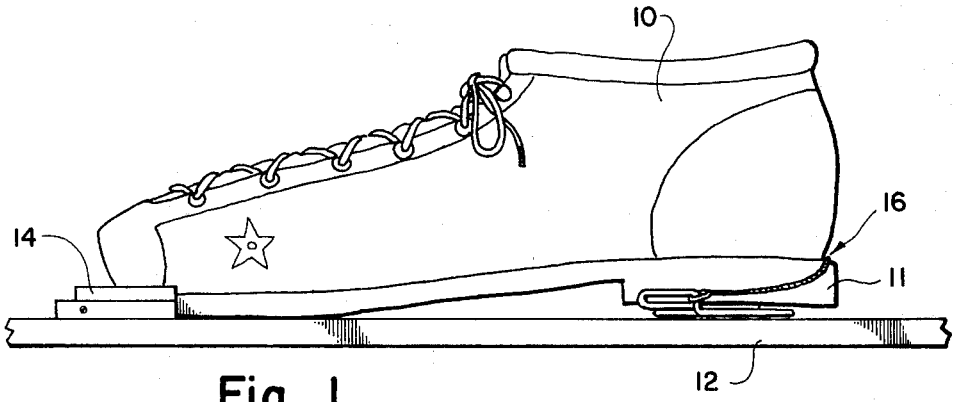
FIG. 1 is a schematic, side elevational view of a boot and ski binding, according to the invention, mounted on a ski in an alpine configuration.
Figure 2:
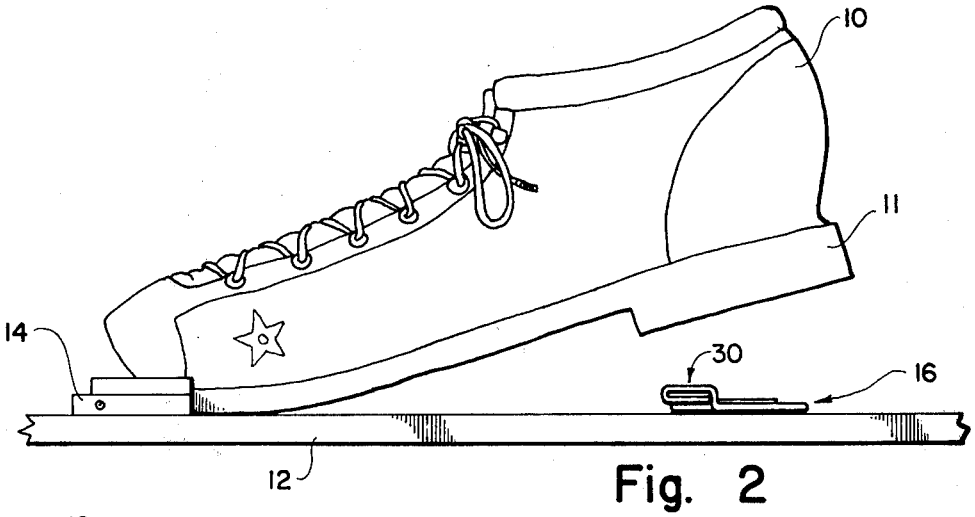
FIG. 2 is a schematic, side elevational view of a boot and ski binding, according to the invention, in a cross country configuration.

As shown in FIG. 1, a light weight cross country ski boot 10 is mounted on a ski 12 by means of a conventional toe clamp type toe binding, and heel binding arrangement, shown generally by the number 16, according to the present invention, holding the heel affixed to the ski for alpine skiing. As shown in FIG. 2, the ski boot 10 is affixed only by means of the toe binding 14 for cross country skiing permitting the heel 11 for the boot 10 to be raised from the heel binding 16 for a cross country or walking configuration.

Figure 3:
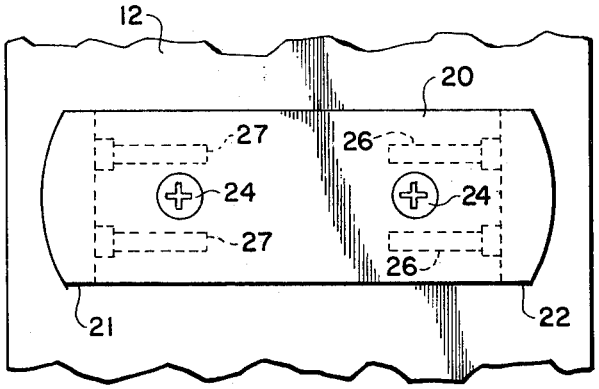
FIG. 3 is a top plan view of a heel support clamping plate.
Figure 4:
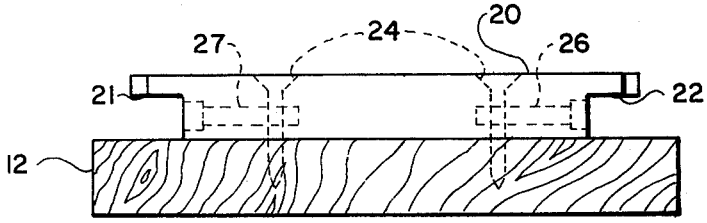
FIG. 4 is a side elevation of FIG. 3.

A clamping plate, shown in FIG. 3, is a rectangular plate 20, having rounded, overhanging side flanges 21 and 22, which is arranged to be mounted on the ski 12 by means of screws 24 passing through holes into the body of the ski. The plate is mounted under the heel of the ski boot. Mounted under the flange 22 is a pair of Allen head screws 26, and a pair of Allen head screws 27 are mounted under the flange 21 on the opposite side, threaded inwardly from the groove under each flange.

These Allen head screws are threadedly mounted in the plate for adjustng the depth of the groove under the flange which holds the heel holding spring with an adjustable stress release, explained below.

Figure 5:
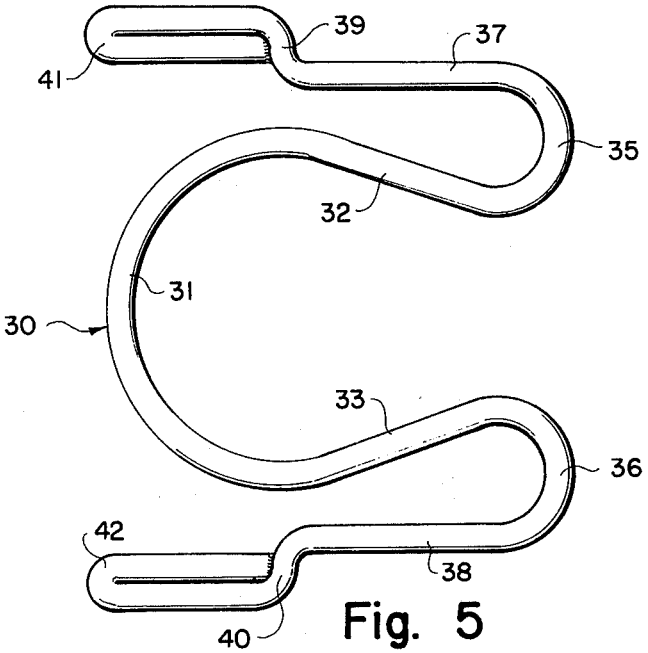
FIG. 5 is a top plan of a heel holder spring support means for attachment to the clamping plate.
Figure 7:
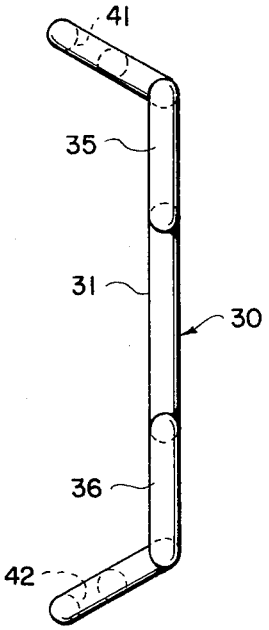
FIG. 7 is a rear elevation of the device of FIG. 5.
Figure 6:
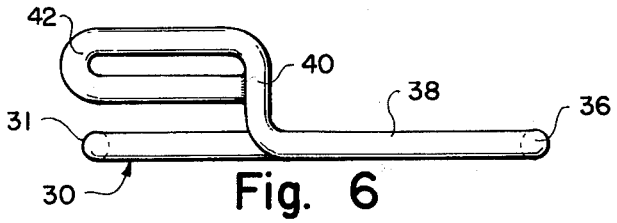
FIG. 6 is a side elevation of the device of FIG. 5

A spring, shown generally by number 30, FIG. 5, includes an accurate section 31 in the form of a semicircle terminating in straight, turned-in section 32 and 33. The straight sections 32 and 33 terminate in reverse bends 35 and 36, respectively. The reverse bends 35 and 36 extend into straight sections 37 and 38 (generally parallel) extending rearwardly of the curved sections, and each of these straight sections terminate in an upwardly direction portion 39 and 40, respectively. A reverse bend (or a 180°) bend 41 and 42 extend respectively beyond the sections 39 and 40 and provide means for attachment of a heel strap or clamp for securing a boot heel to the spring. The upwardly extending sections 39 and 40 extend upwardly and outwardly, preferably at about a 30° angle from the vertical, to permit the easy insertion of a boot heel between the two upstanding portions. The outward angle may extend from about 10° to 45°.

Figure 8:
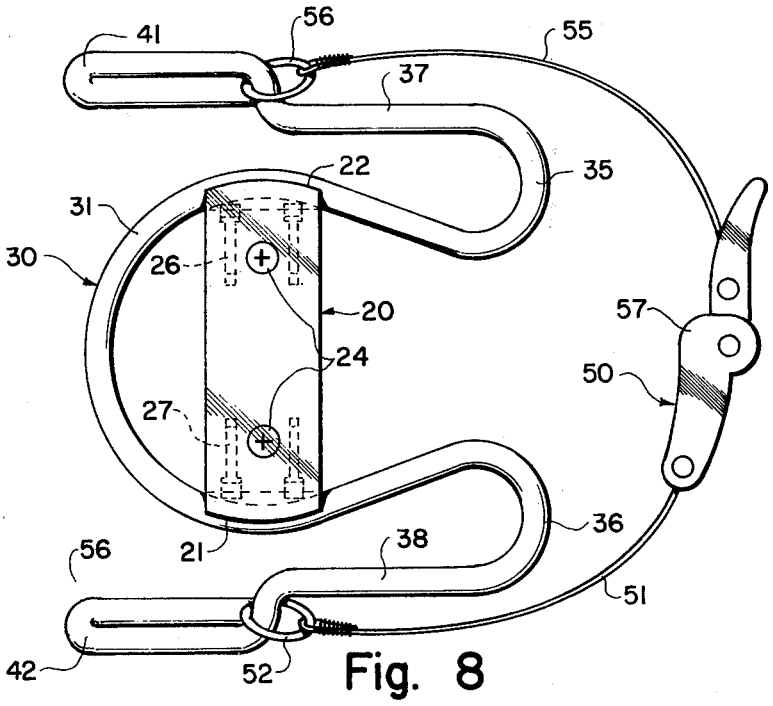
FIG. 8 is a top plan view of the spring heel holder support adjustably mounted on the clamping plate of FIG. 3.

As shown in FIG. 8, the spring binding portion 30 is mounted over the plate 20 by passing the curve 31 along both sides of the plate under the flanges 21 and 22. The Allen head bolts may be threaded in and out of effectively change the depth of the groove under the flanges in relation to the spring and, therefore, provide an adjustable released stress for pulling the spring from beneath the plate. A heel holding cable, rod or strap, shown generally by numeral 50, is provided with a stretch 51 having a ring 52 for passing over the reverse bend 41 and a stretch 55 with a ring 56 for passing over the reverse bend 42. A lever-type tightener is secured to the cables 51 and 55 for tightening around the heel of the boot, in a conventional manner. Other types of tighteners may, obviously, be used.

Figure 9:
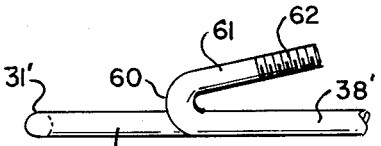
FIG. 9 is a modified form of the invention.

The attachment means between the boot heel holder and the release spring is shown in drawings 1–8 as reverse bends forming loops. A ring or hook may be attached to this arrangement. Other attachment means may be used; one form is shown in FIG. 9. In this embodiment, the reverse bend 31' is similar to that of FIG. 5, and the arms 38' and 37' (not shown) are similar to arms 38 and 37. The ends of arms 38' and 37' are bent upwardly and in a reverse bend 60 of about 20°–45° terminating in a straight section 61, there being equivalent ends on both sides, similar to FIG. 5. End 62 is threaded, and a cap nut (not shown) on the end of a cable (as cables 51 and 55) may be threaded to the end, forming the attachment between the two. This provides for a quick and easily manipulated attachment between the heel cable and the spring-type release. Also, any type of latch arrangement may be used in place of the cam buckle 50, for example, a two-part opening type buckle, a cam lift, "L" shaped heel holder, etc.

The plate 20 is shown generally rectangular, however, it may be of any desired shape. It may, also, include a number of adjusting screws as desired, and it may include adjustment plates that move in and out as the heads of the screws. Various means may be used to secure the plates at the desired position against the edge of the spring holder, as under the overhang 21 and 22. This changes the effective exposure of the overhang on the spring, and, therefore, the variation in release strength.

With the plate 20 attached to the ski and the spring boot clamp holder 30 mounted around the plate, the heel of a boot is secured to the unit by means of the boot clamp arrangement 50 attached to the reverse bends 41 and 42. When it is desired to use the skis in a cross country configuration, the boot toe is clamped to the skis by the toe clamps 14, which may be conventional toe clamps of the pin-type, strap-type or other conventional toe holding bindings, and the heel clamp 50 is removed from the heel by releasing the tightener and removing the loops from the released bends 41 and 42. In this position, the heel may be moved freely up and down, FIG. 2, for walking on the skis. When the skier decides to place the bindings in an alpine position, the heel binding is placed over the spring ends 41 and 42 by means of the loops, and the heel is clamped onto the binding by means of the tightener 57. As the spring is held in the grooves only by the spring tension, any undue twisting, lateral or vertical stress on the unit will pull the spring out of the grooves and the heel is released from the ski, with the spring and the boot clamp attached to the boot. This provides an adjustable safety binding for down hill skiing which, under normal usage, maintains the ski boot flat and securely fastened to the ski.

These and numerous other objects, features and advantages of the invention will become apparent to anyone of ordinary skill in the art upon careful study of the foregoing specification with reference to the drawings and from the following appended claims.

I claim:

1. A ski binding conversion for mounting on cross country skis having a boot toe clamping piece for holding the toe of the boot while the heel is raised, comprising:

a. plate means for attachment to a ski positioned to permit a boot heel to rest thereon; said plate means having overhanging flanges on opposed sides thereof each said overhanging flange defining a groove;

b. spring clamp means having resiliently deformable opposed sides arranged to extend around said plate with said opposed sides under said flanges, and having heel clamp attachment means depending from said opposed sides;

c. adjustable means mounted in the groove under each said flange to vary the depth of the groove in relation to said spring means to vary release strength; and d. removable boot heel clamp means arranged to be removably secured to said heel clamp attachment means for securing a boot heel to said spring clamp means.

2. A ski binding conversion according to claim 1, wherein said adjustable means includes at least one threaded bolt in each groove.

3. A ski binding conversion according to claim 1, wherein said plate means is rectangular, and said flanges are arranged to extend laterally of the ski on which it is mounted.

4. A ski conversion according to claim 1 wherein said spring clamp means is a one piece rod and includes a bending rearward portion extending from each of said opposed sides to said heel clamp attachment means which comprise bends in the ends of said rod.

* * * * *